US010113404B2

(12) United States Patent
Hriscu et al.

(10) Patent No.: US 10,113,404 B2
(45) Date of Patent: Oct. 30, 2018

(54) IGNITING UNDERGROUND ENERGY SOURCES

(71) Applicant: Halliburton Energy Services, Inc., Houston, TX (US)

(72) Inventors: Iosif Hriscu, Duncan, OK (US); Christopher T Linsky, Marlow, OK (US); Nicholas Moelders, Spring, TX (US); Wei-Ming Chi, Tomball, TX (US); Richard Joseph Hampson, Aberdeenshire (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/573,787

(22) PCT Filed: Jun. 6, 2016

(86) PCT No.: PCT/US2016/036062
§ 371 (c)(1),
(2) Date: Nov. 13, 2017

(87) PCT Pub. No.: WO2016/205006
PCT Pub. Date: Dec. 22, 2016

(65) Prior Publication Data

US 2018/0087355 A1 Mar. 29, 2018

Related U.S. Application Data

(60) Provisional application No. 62/175,880, filed on Jun. 15, 2015, provisional application No. 62/175,869,
(Continued)

(51) Int. Cl.

| | |
|---|---|
| ***E21B 43/243*** | (2006.01) |
| ***E21B 43/295*** | (2006.01) |
| ***E21B 41/00*** | (2006.01) |

(52) U.S. Cl.
CPC ..... *E21B 43/243* (2013.01); *E21B 41/0092* (2013.01); *E21B 43/295* (2013.01)

(58) Field of Classification Search
CPC .... E21B 43/243; E21B 43/006; E21B 43/247; E21B 43/295; E21B 2043/0115
See application file for complete search history.

(56) References Cited

U.S. PATENT DOCUMENTS 3,948,238 A 4/1976 Jamieson
3,999,607 A * 12/1976 Pennington ..... E21B 43/18 166/259
(Continued)

FOREIGN PATENT DOCUMENTS

GB 2486613 6/2012
GB 2501074 A * 10/2013 ..... E21B 43/295
(Continued)

OTHER PUBLICATIONS

International Search Report and Written Opinion for PCT/US16/36062 dated Dec. 22, 2016.
(Continued)

*Primary Examiner* — Zakiya W Bates
(74) *Attorney, Agent, or Firm* — Alan Bryson; Tumey L.L.P.

(57) ABSTRACT

A system and method for underground gasification. A system for underground gasification system may comprise a recovery system, a supply line, and a downhole ignition device operable to ignite an underground energy source. The downhole device may be connected to the supply line and the supply line may be connected to the recovery system. The system for underground gasification may further comprise an information handling system that may be operable to control the downhole device. A method for igniting an underground energy source may comprise disposing a downhole ignition device into an injection well, positioning
(Continued)

the downhole ignition device within the underground energy source, activating the downhole ignition device, igniting the underground energy source, and recovering a gas from the underground energy source.

20 Claims, 6 Drawing Sheets

Related U.S. Application Data filed on Jun. 15, 2015, provisional application No. 62/175,864, filed on Jun. 15, 2015, provisional application No. 62/175,853, filed on Jun. 15, 2015, provisional application No. 62/175,850, filed on Jun. 15, 2015.

(56) References Cited

U.S. PATENT DOCUMENTS 4,109,719 A * 8/1978 Martin ..... E21B 43/006 166/259
4,499,945 A 2/1985 Hill
4,614,234 A * 9/1986 Puri ..... E21B 43/243 166/261
2002/0141288 A1 10/2002 West
2008/0236817 A1 10/2008 Tillman
2013/0161007 A1 6/2013 Wolfe et al.
2013/0312950 A1 11/2013 Shaikh et al.
2015/0041125 A1 2/2015 Perkins et al.

FOREIGN PATENT DOCUMENTS

WO 2012109711 8/2012
WO 2014089603 6/2014

OTHER PUBLICATIONS

"Review of underground coal gasification conceptions" by Barbara Bialecka. Published in Research Reports Mining and Environment in Apr. 2006. (No Translation provided).

* cited by examiner

IGNITING UNDERGROUND ENERGY SOURCES

BACKGROUND

Underground gasification may be an alternative method of extracting energy from an underground energy source. The method may involve drilling multiple wells into an underground energy source and igniting the underground energy source. Typically, the wells may be connected within the underground energy source to form a horizontal well. The underground energy source may be ignited to produce synthetic gas, "syngas", which may flow or be pumped out of a recovery well, connected to the underground energy source.

The ignition and re-ignition of an underground energy source may often be unreliable. Current methods of ignition may include the use of (1) pyrophoric gases, (2) chemical reactants, or (3) electrical glow plugs or resistors. The use of pyrophoric gases and chemical reactants may present safety and environmental hazards, leading to the risk of increased injuries and increased risk-mitigation costs. Additionally, current technology in igniting an underground energy source may often be impractical and not cost effective. Thus, there is needed a more cost effective and reliable system and method for the ignition and re-ignition of an underground energy source.

BRIEF DESCRIPTION OF THE DRAWINGS

These drawings illustrate certain aspects of some of the examples of the present invention, and should not be used to limit or define the invention.

DETAILED DESCRIPTION

The present disclosure relates to a system and method for initiating and monitoring an underground gasification process. This disclosure may also describe use of a number of different ignition systems to ignite an underground energy source including, but not limited to, a piezoelectric igniter system, a fuel igniter system, a paddle igniter system, a laser ignition system, and/or a chemical igniter system.

Underground gasification may be a process used to create synthetic gas by igniting an underground energy source. Typically, two or more wells may be drilled into an underground energy source. Each well may be connected within the underground energy source, for example, to create a horizontal well. One or more wells may be used as an injection well, and one or more wells may be used as a recovery well. The injection and recovery wells may be on the same or different sides of the underground energy source.

A downhole ignition device may be inserted into the injection well and may ignite the underground energy source. Once the underground energy source is ignited, a synthetic gas, "syngas", may be produced as the underground energy source burns. Syngas may include, but is not limited to methane, hydrogen, carbon monoxide, carbon dioxide, water vapor, air, and/or oxygen. This syngas may flow or may be pumped out through a recovery well. The downhole ignition device may typically be removed from the burning underground energy source to a location in the injection well (or at the surface) and may be utilized within the horizontal well or injection well. Additionally, the underground energy source may require re-ignition. To re-ignite the underground energy source, the downhole ignition device may be sent downhole and disposed adjacent the underground energy source. The ignition process, described above, may be repeated in an effort to re-ignite the underground energy source.

The downhole ignition device may also record and transmit bottom hole conditions such as pressure, temperature, and humidity through a communication line. These recordings may be transmitted to the ground surface in real time to control the gasification process. Temperature sensors may be used to determine when the underground energy source is sufficiently burning, allowing for removal of the downhole ignition device from the well. Water or steam may be used during underground gasification to control air temperatures within the burning underground energy source. Additionally, the downhole ignition device may detect, measure, and/or transmit data regarding gases disposed in the underground energy source, including, but not limited to, methane, hydrogen, carbon monoxide, carbon dioxide, water vapor, air, and/or oxygen. The downhole ignition device may also utilize a casing collar locator or a Gamma sensor for accurate placement of the downhole ignition device in the underground energy source for maximum efficiency.

Figure 1:
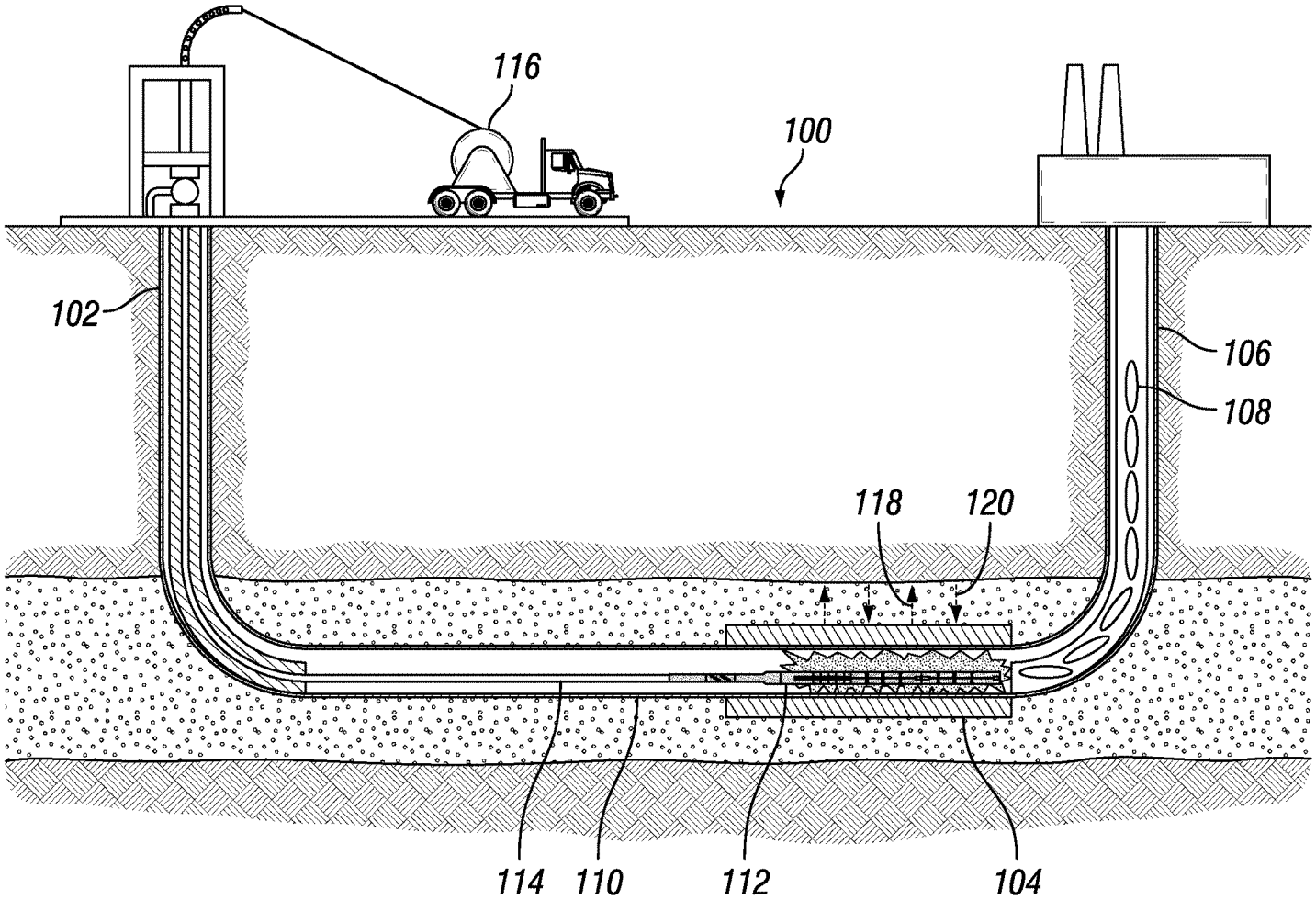
FIG. 1 is an example of cut away view of an underground gasification system.

FIG. 1 illustrates an example of an underground gasification system 100, which may be used to extract a fuel gas 108 from underground energy source 104. In examples, underground energy source 104 may be a substance within an underground formation from which fuel gas 108 may be derived. Without limitation, examples of underground energy source 104 may comprise coal and/or other hydrocarbon feedstock from which fuel gas 108 may be derived. Non-limiting examples of fuel gas 108 may comprise syngas, for example, which may be derived from gasification of coal. As illustrated, an injection well 102 may be drilled from the surface into underground energy source 104 and may be used to inject tools, gases, and/or the like into the ground and/or underground energy source 104. Generally, injection well 102 may include horizontal, vertical, slanted, curved, and other types of wellbore geometries and orientations. Injection well 102 may be cased or uncased. A recovery well 106 may be drilled from the surface into underground energy source 104 and may allow for the recovery of fuel gas 108, where gas 108 may comprise "syngas," produced during gasification. Generally, recovery well 106 may include horizontal, vertical, slanted, curved, and other types of wellbore geometries and orientations. Horizontal well 110 may be drilled along underground energy source 104 in the direction of the desired gasification and may connect injection well 102 and recovery well 106.

Injection well 102, horizontal well 110, and/or recovery well 106 may be lined with a casing or multiple casings and/or include uncased sections.

Underground gasification system 100 may include downhole ignition device 112 that may be used to ignite underground energy source 104 and collect data that may be transmitted to the ground surface. As illustrated in FIG. 1, downhole ignition device 112 may be lowered into injection well 102 using supply line 114. Supply line 114 may comprise coiled tubing, wireline, and/or the like, and may also attach to a recovery system 116. The wireline may be a slick line or electric wireline (what may be referred to as an e-line). In examples, the slick line may be more robust and less expensive than electric wirelines and may therefore often be used in applications that do not require electrical and/or communication with the surface. An electric wireline may comprise a plurality of electrical conductors, which may be disposed at the core of a wound and/or braided cable. In examples, the electric wireline may be disposed within supply line 114. The electric line may comprise a wire-wrapped electrical conduit, which may be capable of transporting 250 volts using alternating current at 0.5 amps. Additionally, the electric line may be capable of powering, controlling, sending and/or receiving data between downhole ignition device 112 and the surface. Recovery system 116 may comprise a reel with supply line 114 and may have the capacity to hold and/or recover any length of supply line 114. During underground gasification, underground energy source 104 may burn as illustrated in FIG. 1. Gasification may produce heat and hot gases 118. Water influx 120 may control underground gasification, which may dispose water into and/or near underground energy source 104. Water influx 120 may control temperatures during gasification, which may allow for more efficient ignition of underground energy source 104 and gasification generally. Alternatively, water and/or steam may be supplied from the surface.

Figure 2:
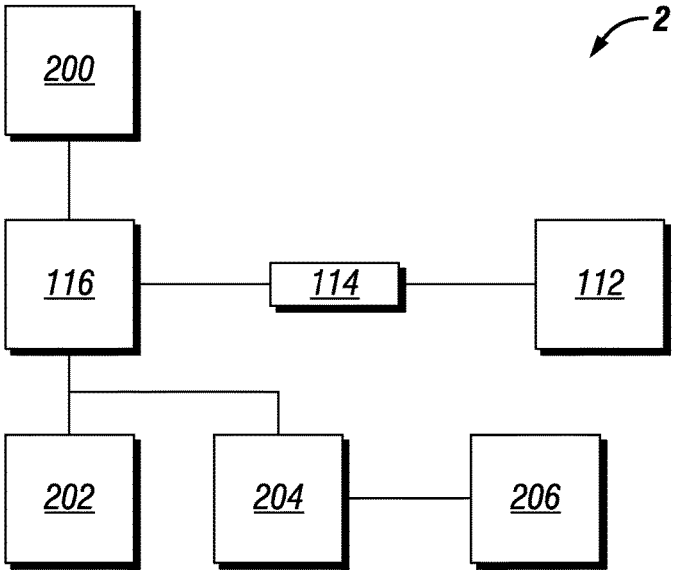
FIG. 2 is an example schematic of an underground gasification system.

FIG. 2 illustrates an example of a schematic of an underground gasification system 100. In FIG. 2, downhole ignition device 112 may be connected to supply line 114, which may be connected to recovery system 116. Supply line 114 may include, but is not limited to, an accelerant system 200, a power line 202, and/or a communication line 204. Additionally, power line 202 and communication line 204 may be combined into a single line or may comprise several lines. Without limitation, accelerant system 200 may house and/or supply oxygen, fuel, air, nitrogen dioxide, combinations thereof, and/or the like, which may be used downhole for combustion. Power line 202 may comprise an electrical line and/or a similar power source, and may provide power to various components within downhole ignition device 112, including, but not limited to, electrical sensors, the igniter mechanism, valve systems, and pumps. Communication line 204 may transmit data collected at or near downhole ignition device 112 to the surface, may transmit signals from the ground surface to downhole ignition device 112, and may transmit signals to other systems as required. Communication line 204 may comprise a fiber optic cable, electrical conduit, and/or the like. Additionally, communication line 204 may be used to activate and deactivate downhole ignition device 112, which in turn may ignite underground energy source 104. Without limitation, communication line 204 may connect to information handling system 206.

Certain examples of the present disclosure may be implemented at least in part with an information handling system 206. For purposes of this disclosure, information handling system 206 may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, information handling system 206 may be a personal computer, a network storage device, or any other suitable device and may vary in size, shape, performance, functionality, and price. Information handling system 206 may include random access memory (RAM), one or more processing resources such as a central processing unit (CPU) or hardware or software control logic, ROM, and/or other types of nonvolatile memory. Additional components of information handling system 206 may include one or more disk drives, one or more network ports for communication with external devices as well as various input and output (I/O) devices, such as a keyboard, a mouse, and a video display. Information handling system 206 may also include one or more buses operable to transmit communications between the various hardware components.

Certain examples of the present disclosure may be implemented at least in part with non-transitory computer-readable media. For the purposes of this disclosure, non-transitory computer-readable media may include any instrumentality or aggregation of instrumentalities that may retain data and/or instructions for a period of time. Non-transitory computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Figure 3:
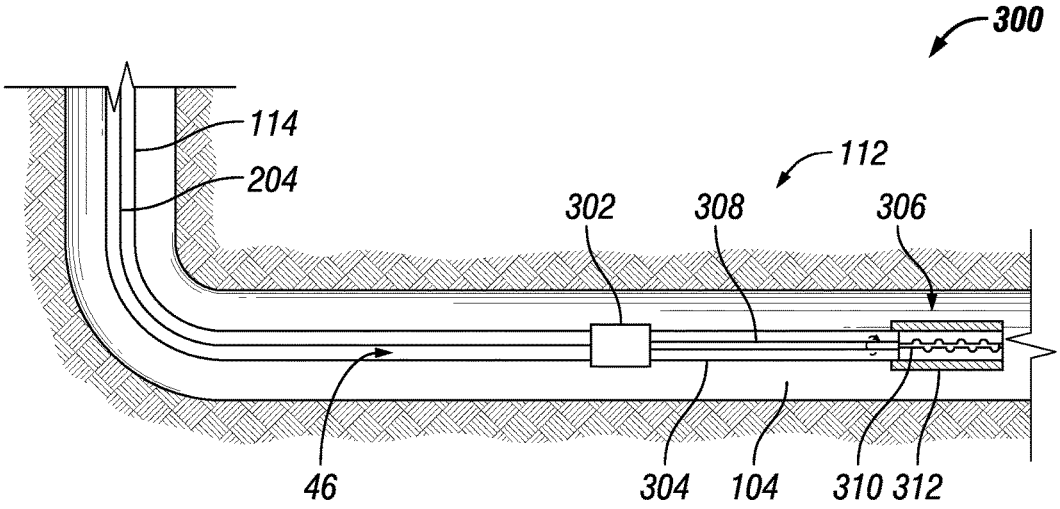
FIG. 3 is an example of a side view of a piezoelectric igniter system.

As described above, downhole ignition device 112 may ignite underground energy source 104. Without limitation, as illustrated in FIG. 3, downhole ignition device 112 may be a piezoelectric igniter system 300. In examples, piezoelectric igniter system 300 may comprise a motor 302. In examples, motor 302 may be electric and/or a hydraulic motor. Motor 302 may be any suitable device which may be able to function in a downhole environment. In examples, motor 302 may be connected to a lance 304. Lance 304 may be a hollow tube of any suitable length in which to separate motor 302 and other device components from an ignition subassembly 306. Lance 304 may extend from motor 302 to a distal end of piezoelectric igniter system 300. A shaft 308 may connect to motor 302 and be a length about equal to lance 304. During operation, motor 302 may spin shaft 308 in a clockwise and/or counter-clock wise rotation. Shaft 308 may connect to cam 310 within ignition subassembly 306.

Ignition subassembly 306 may comprise a cam 310 and a piezoelectric igniter 312, which may be a rotary piezoelectric igniter. Piezoelectric igniter 312 may comprise of a suitable piezoelectric material, such as quarts, berlinite, sucrose, rochelle salt, topaz, tourmaline-group minerals, lead titanate, and/or any combination there. Without limitation there may be any number of cams 310 disposed within ignition subassembly 306. Cam 310 may be engaged and/or engage piezoelectric igniter 312. Cam 310 may be made of any suitable material, including ferrous alloy. When igniting an underground energy source 104, motor 302 may rotate cam 310 through shaft 308. Without limitation, information handling system 206 may control the operation of motor 302 through communication line 204. Frictionally engaged to piezoelectric igniter 312, cams 310 may cause piezoelectric igniter 312 material to deform. Deformation of piezo material may create a voltage charge across piezoelectric igniter 312. The charge may arc across piezoelectric igniter 312 and ignite fuel, which may be traversing the length of piezoelectric igniter 312. In examples, fuel may be supplied through supply line 114 from the surface. Additionally, the control and/or flow of fuel through piezoelectric igniter system 300 may be controlled by information handling system 206 at the surface. Without limitation, fuel may be methane, butane, propane, any combination thereof, and/or the like. Ignited, fuel may produce heat that may be used to ignite underground energy source 104. In examples, an oxygen source may be transported through supply line 114 and/or injection well 102 to downhole ignition device 112 to accelerate the ignition process. Additionally, the addition of oxygen and/or flow of oxygen may be controlled by information handling system 206 at the surface. Ignition of underground energy source 104 by downhole ignition device 112 may allow for downhole ignition device 112 to be removed to the surface and/or away from underground energy source 104. In examples, underground energy source 104 may require re-ignition. To re-ignite underground energy source 104, downhole ignition device 112 may be re-positioned adjacent underground energy source 104. The ignition process, described above, may be repeated in an effort to re-ignite underground energy source 104.

Figure 4:
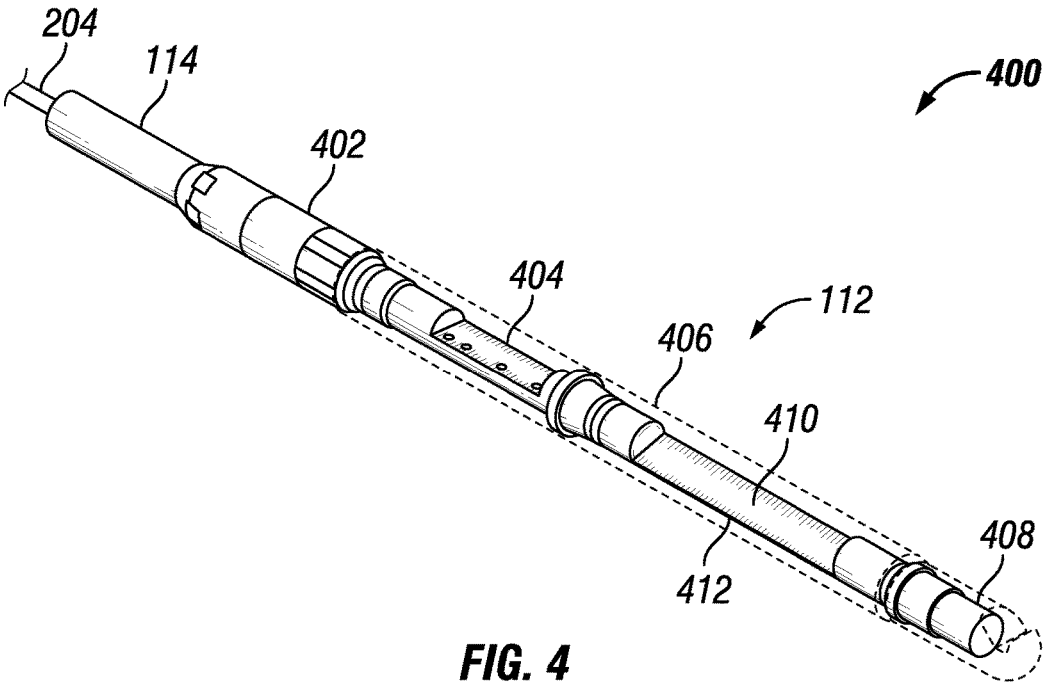
FIG. 4 is an example of a side view of a fuel igniter system.

FIG. 4 illustrates another example of downhole ignition device 112. Without limitation, downhole ignition device 112 may comprise a fuel igniter system 400. Fuel igniter system 400 may comprise a connector 402, electronic sensor subassembly 404, fuel supply subassembly 406, ignition subassembly 408, and/or any combination of these subassemblies. In examples, connector 402 may connect fuel igniter system 400 to supply line 114. Without limitation, connector 402 may release fuel igniter system 400 from supply line 114. Release and/or attachment of connector 402 to supply line 114 may be controlled by information handling system 206 (Referring to FIG. 2), which may connect to connector 402 through communication line 204. In examples, electronic sensor subassembly 404 may attach to connector 402. Electronic sensor subassembly 404 may contain sensors that may measure temperature, pressure, humidity, and/or the like. Sensors may communicate information and/or data through communication line 204 to information handling system 206. In examples, fuel supply subassembly 406 may attach to electronic sensor subassembly 404 and may hold a first container 410 and a second container 412. Without limitation, first container 410 and second container 412 may hold fuel, accelerant, and/or any combination thereof. Fuel supply subassembly 406 may supply fuel and/or accelerant to fuel igniter system 400 to achieve ignition. The flow of fuel and/or accelerant may be controlled by information handling system 206. Information handling system 206 may communicate with fuel supply subassembly 406 through communication line 204. Without limitation, fuel supply subassembly 406 may be interchanged with other fuel supply assemblies (not illustrated) and/or re-filled with fuel and/or accelerant at the surface. Without limitation, fuel and/or accelerant may traverse through fuel supply subassembly 406 to ignition subassembly 408. In examples, fuel and/or accelerant may be supplied from the surface through fuel igniter system 400 through supply line 114.

Figure 5:
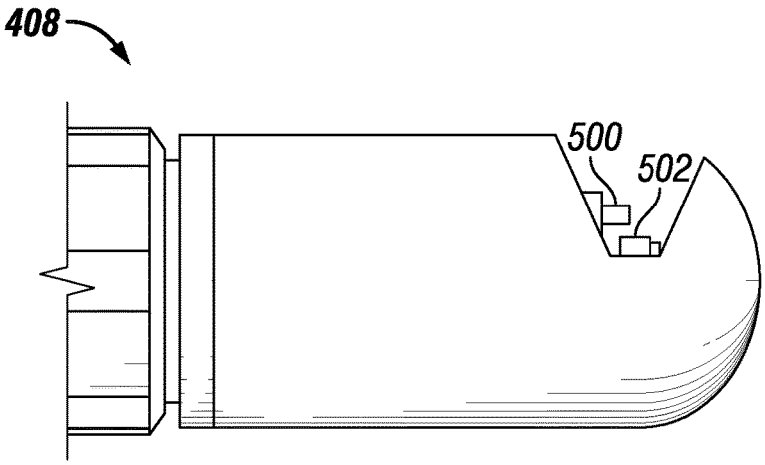
FIG. 5 is an example of a side view of an ignition subassembly.
Figure 6:
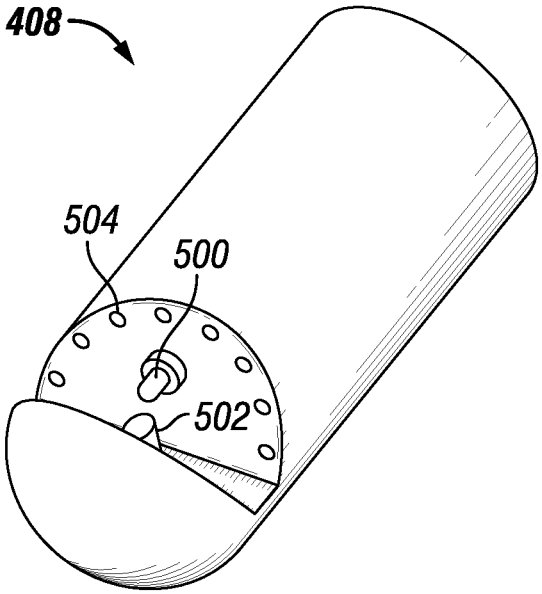
FIG. 6 is an example of a perspective view of an ignition subassembly.

FIGS. 5 and 6 illustrate an example of the ignition subassembly 408 in FIG. 4, which may be used to ignite underground energy source 104 (Referring to FIG. 1). Ignition subassembly 408 may comprise, but is not limited to, a resistance device 500 and a fuel nozzle 502. Resistance device 500 may comprise a glow plug and/or the like and may be powered by power line 202 (Referring to FIG. 2) and/or a power source (not illustrated) contained within fuel igniter system 400. Fuel nozzle 502 may inject fuel contained in fuel supply subassembly 406, accelerant, and/or a combination of fuel and/or accelerant. Resistance device 500 may generate the heat necessary to cause a combustion reaction with fuel, accelerant, or any combination thereof, which may be supplied by fuel nozzle 502 and/or another source. Ignition subassembly 408 may further comprise a plurality of ports 504. Ports 504 may be disposed in any arrangement on ignition subassembly 408. In examples, accelerant may move through ports 504 and mix with fuel and/or vice versa. The mixture of accelerant and fuel may help in the ignition of fuel and/or intensify the combustion process. This combustion reaction may ignite underground energy source 104, which may produce fuel gas 108 (referring to FIG. 1, for example) and other forms of energy. The gases and/or energy may be extracted and/or pumped through recovery well 106. After ignition of underground energy source 104 downhole ignition device 112, may be removed to the surface or away from underground energy source 16. Without limitation, fuel igniter system 400 may be detached at connector 402 downhole and supply line 114 may be brought to the surface. As discussed above, fuel supply subassembly 406 may be removed and replaced and/or refilled with fuel and/or accelerant. In examples, underground energy source 104 may require re-ignition. To re-ignite underground energy source 104, downhole ignition device 112 may be re-positioned adjacent underground energy source 104. The ignition process, described above, may be repeated in an effort to re-ignite underground energy source 104.

Figure 7:
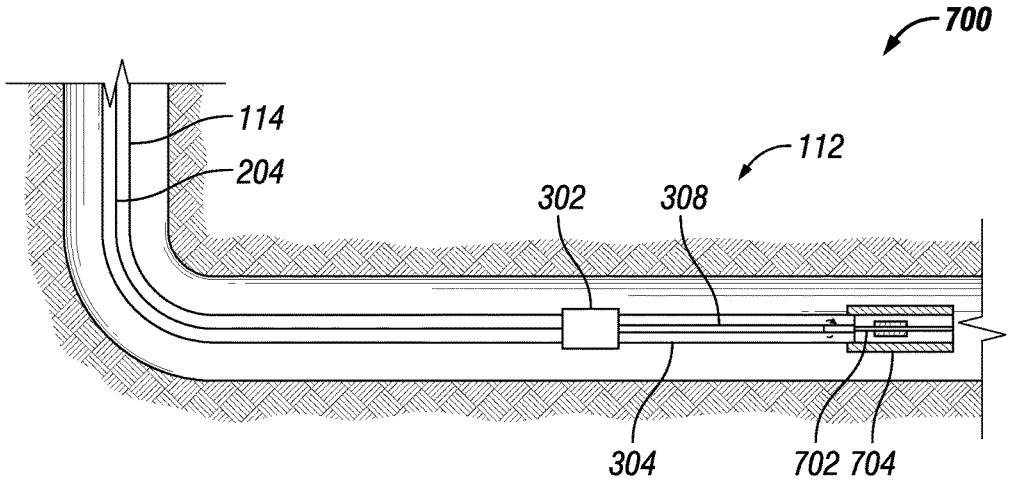
FIG. 7 is an example of a side view of a paddle igniter system.

FIG. 7 illustrates another example of downhole ignition device 112. Without limitation, downhole ignition device 112 may comprise a paddle igniter system 700. In examples, paddle igniter system 700 may comprise a motor 302. In examples, motor 302 may be electric and/or a hydraulic motor. Motor 302 may be any suitable device which may be able to function in a downhole environment. In examples, motor 302 may be connected to a lance 304. Lance 304 may be a hollow tube of any suitable length in which to separate motor 302 from paddle igniter system 700. A shaft 308 may connect to motor 302 and be a length about equal to lance 304. During use, motor 302 may spin shaft 308 in a clockwise or counter-clock wise rotation. Shaft 308 may connect to paddles 702 within paddle igniter system 700.

Paddle igniter system 700 may be disposed at a distal end of downhole ignition device 112. Paddle igniter system 700 may comprise paddles 702 and ignition sleeve 704. Ignition sleeve 704 may comprise magnesium and/or any ignitable pyrophoric composite material. Paddles 702 may be frictionally engaged to ignition sleeve 704 and/or separated from ignition sleeve 704. Paddles 702 may be made of any suitable material, including ferrous alloy. When igniting an underground energy source 104, motor 302 may rotate paddles 702 through shaft 308. Frictionally engaged to ignition sleeve 704, paddles 702 may initiate enough heat to ignite ignition sleeve 704. Once ignited, ignition sleeve 704 may ignite underground energy source 104. Without limitation, oxygen may be transported to downhole ignition device 112 to accelerate the ignition process. Ignition sleeve 704, once ignited, may completely burn away. In examples, underground energy source 104 may require further and/or re-ignition. To re-ignite underground energy source 104, downhole ignition device 112 may be removed to the surface and an additional ignition sleeve 704 may be placed upon lance 304. Alternatively, a plurality of ignition sleeves 704 may be positioned on lance 304 that can be used for re-ignition. Downhole ignition device 112 may then be sent downhole back to underground energy source 104 and ignition sleeve 704 may be reignited using motor 302 and paddles 702. In examples, a casing of downhole ignition device 112 may comprise fiber optic sensors, which may monitor the temperature profile in and around downhole ignition device 112.

Figure 8:
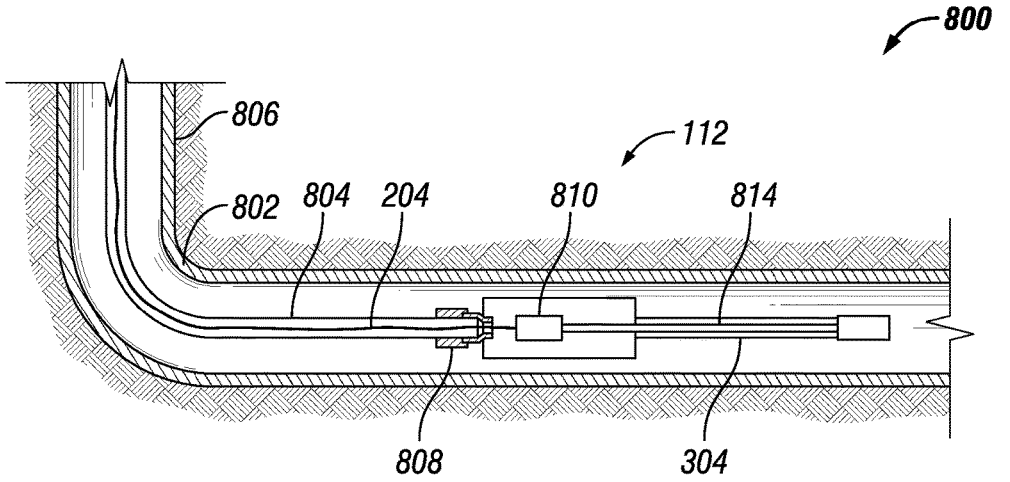
FIG. 8 is an example of a side view of a laser ignition system.

FIG. 8 illustrates another example of downhole ignition device 112. Without limitation, downhole ignition device 112 may comprise a laser ignition system 800 that may be utilized in underground gasification system 100 (referring to FIG. 1, for example). In examples, annulus 802 may be utilized to cool laser ignition system 800. Annulus 802 may be formed between a first casing 804 (e.g. or other conduits) and a second casing 806 (e.g. or other conduits). Specifically, cold air may be pumped from the surface to laser ignition system 800. Without limitation, laser ignition system 800 may comprise a circulating valve 808. Circulating valve 808 may utilize coolant to control temperatures and/or other conditions in laser ignition system 800. Circulating valve 808 may allow for the circulation of coolant from the surface to laser ignition system 800, laser source 810, and/or other subassemblies and/or systems and back to the surface. Laser source may connect to information handling system 206 through communication line 204. In examples, laser source 810 may be switched on and/or off by information handling system 206. Lance 304 may attach to laser ignition system 800. Without limitation, lance 304 may contain optical fiber 814, which may transmit light from laser source 810 a distance from the laser source 810 and thus keep the electronic apparatus away from heat. Additionally, lance 304 may contain an ignitable target, which may act as a glow plug to maintain high temperature long enough to initiate the ignition of underground energy source 104. Laser ignition system 800 and lance 304 may be sealed from downhole environment conditions.

Additionally, underground gasification system 100 may use an accelerant and/or a fuel to achieve ignition of underground energy source 104. An accelerant may be comprised of oxygen, air, nitrogen dioxide, combinations thereof, and/or the like. A fuel may be comprised of methane, butane, propane, and/or the like. An accelerant and/or a fuel may flow from the surface using supply line 114 to laser ignition system 800 and/or underground energy source 104. Additionally, an accelerant and/or fuel may be contained in canisters disposed in laser ignition system 800 and/or another subassembly of underground gasification system 100.

Figure 9:
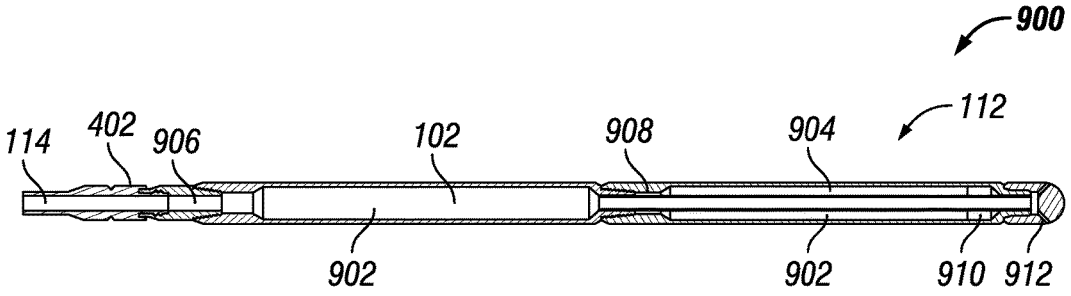
FIG. 9 is an example of a cross-section view of an chemical igniter system.

FIG. 9 illustrates another example downhole ignition device 112 that may be used in underground coal gasification. Without limitation, downhole ignition device 112 may comprise a chemical igniter system 900. As illustrated, chemical igniter system 900 may be coupled to supply line 114, which may support and position chemical igniter system 900 in the wellbore (e.g., horizontal well in FIG. 1, for examples). In examples, power line 202 (referring to FIG. 1) and communication line 204 (referring to FIG. 1, for example) may be disposed in supply line 114. Supply line 114 may be coupled to chemical igniter system 900 at connector 402, which may be a coiled tubing connector, for example.

Chemical igniter system 900 may comprise, but is not limited to, connector 402, a first chemical container 902, a second chemical container 904, a first valve 906, a second valve 908, a third valve 910, a chemical mix chamber 912, or any combination of these subassemblies. Chemical igniter system 900 may also comprise sensors that may measure temperature, pressure, humidity, and/or the like. The first chemical container 902, second chemical container 904, first valve 906, second valve 908, and third valve 910 may each be comprised of a metal, a composite, and/or the like. The first chemical container 902 may comprise a first chemical, which may comprise fuel, methane, butane, propane, and/or the like. Additionally, second chemical container 904 may comprise a second chemical, which may comprise accelerant, oxygen, air, silane, and/or the like. Without limitation, fuel and/or accelerant may be disposed in either/or both of first chemical container 902 or second chemical container 904. Those ordinary of ordinary skill in the art, with the benefit of this disclosure, should be able to select appropriate chemicals that may react upon mixing to ignite underground energy source 104.

In examples, accelerant may flow through supply line 114 and may saturate underground energy source 104. Information handling system 206 may operate power line 202 and communication line 204 to operate a first valve 906, second valve 908, third valve 910, and/or other valves as needed. First valve 906 may be opened and/or closed using a command from information handling system 206. Opening first valve 906 may allow the first chemical container 902 to dispose a first chemical into chemical mix chamber 912 and/or to another area. Additionally, second valve 908 may be opened and/or closed using a command from information handling system 206. Opening second valve 908 and third valve 910 may allow second chemical container 904 to dispose a second chemical into chemical mix chamber 912 and/or to another area. Disposing the first chemical from the first chemical container 902 and the second chemical from second chemical container 904 into chemical mix chamber 912 and/or another area may cause a combustion reaction between the first chemical and the second chemical, which may ignite and/or burn underground energy source 104. The ignition and/or burning of underground energy source 104 may be accelerated by accelerant. In examples, mixture of the first and second chemicals may cause a combustion reaction, which may ignite and/or burn accelerant. The ignition and/or burning of accelerant may ignite and/or burn underground energy source 104.

In examples, chemical igniter system 900 may be disposed near underground energy source 104, injection well 102, and/or another location to allow for re-ignition of underground energy source 104 as needed. First chemical container 902 and second chemical container 904 may have the capacity to dispose sufficient fuel for ignition of underground energy source 104 and/or one or more re-ignitions of underground energy source 104. Additionally, first chemical container 902 and second chemical container 904 may be replaced for other chemical containers or may be refilled as needed. In an alternative example, chemical igniter system 900 may contain more than two chemicals and more than two chemical containers to allow for a combustion reaction, which may ignite and/or burn underground energy source 104.

Chemical igniter system 900 may also be configured to dispose a single chemical that may mix with accelerant to create a combustion reaction. A configuration may contain a first chemical container 902, which may contain a chemical, such as, but not limited to, silane and/or the like. The first chemical may be disposed using a first valve 906. Accelerant may flow from supply line 114 or may be disposed from second chemical container 904 using second valve 908. Accelerant 24 may mix with first chemical to cause a combustion reaction, which may ignite and/or burn underground energy source 104.

Additionally, an ignition target may be used to promote ignition of underground energy source 104. The ignition target may be placed adjacent to chemical mixing chamber 912 and may be comprised of, iron oxide, thermite, and/or the like.

Figure 10:
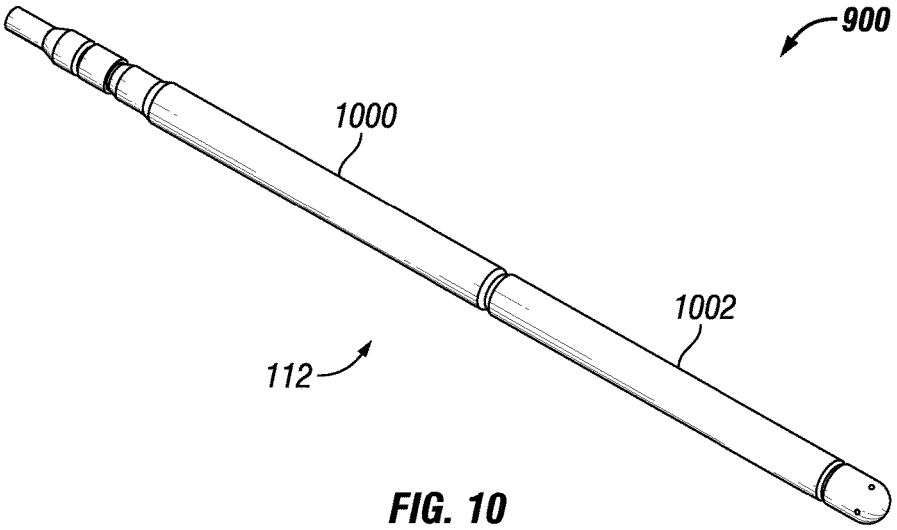
FIG. 10 is an example of a perspective view of the chemical igniter system.

FIG. 10 illustrates an example of a first shell 1000 and a second shell 1002, which may be used to protect and conceal the subassemblies described above and/or other systems as required. Connector 402 may connect supply line 114 and first shell 1000. Additionally, first shell 1000 may be connected to second shell 1002. More than two shells may be used as needed. First shell 1000, second shell 1002, and/or other shells may be comprised of metal, a composite, and/or the like.

Without limitation, the underground gasification systems disclosed herein may be used in a wide variety of subterranean applications for ignition of an underground energy source. Without limitation, an underground gasification system may comprise a recovery system, a supply line, a downhole ignition device operable to ignite an underground energy source. The downhole ignition device may be connected to the supply line and the supply line may be connected to the recovery system. The underground gasification system may further comprise an information handling system that may be operable to control the downhole ignition device. This system may include any of the various features of the compositions, methods, and systems disclosed herein, including one or more of the following features in any combination. A piezoelectric igniter system that may comprise a motor, a lance, a shaft, a cam, and a piezoelectric igniter. The information handling system may be operable to control the piezoelectric igniter system. The information handling system may operate the motor, and wherein the motor rotates the shaft which rotates the cam against the piezoelectric igniter. A fuel igniter system that may comprise a connector, an electronic sensor subassembly, a fuel supply subassembly, and ignition subassembly. The information handling system may be operable to control the fuel igniter system, where the information handling system may control a flow of a fuel or an accelerant through the fuel supply subassembly to the ignition subassembly, and where the information handling system may activate a resistance device disposed on the ignition subassembly to ignite the fuel or the accelerant. A paddle igniter system that may comprise a motor, a lance, a shaft, a paddle, and an ignition sleeve. The information handling system may be operable to control the paddle igniter system. The information handling system may operate the motor and the motor may rotate the shaft which may rotate the paddle against the ignition sleeve. The downhole ignition device may comprise a laser ignition system that may comprise a laser source, a lance, an optical fiber, and a circulating valve. The information handling system may be operable to control the laser ignition system and may turn the laser ignition system on and/or off. A chemical igniter system that may comprise a connector, a first chemical container, a second chemical container, a first valve, a second valve, a third valve, and a chemical mix chamber. The information handling system may be operable to control the chemical igniter system and operate the first valve, the second valve, and the third valve to mix a first chemical from the first chemical container and a second chemical from the second chemical container in the chemical mix chamber.

Without limitation, a method for igniting an underground energy source may comprise disposing a downhole ignition device into an injection well, positioning the downhole ignition device within the underground energy source, activating the downhole ignition device, igniting the underground energy source, and recovering a gas from the underground energy source. This method may include any of the various features of the compositions, methods, and systems disclosed herein, including one or more of the following features in any combination. The method may further comprise removing the downhole ignition device from the underground energy source, inserting oxygen, water, or accelerant to control burning of the underground energy source, re-positioning the downhole ignition device within the underground energy source, and re-igniting the underground energy source with the downhole ignition device. The method may further comprise operating the downhole ignition device with an information handling system. The downhole device may be a piezoelectric igniter system where the piezoelectric igniter may produce heat. The method may further comprise operating the downhole device with an information handling system. The downhole device may be a fuel igniter system, injecting a fuel and/or an accelerant from a fuel supply subassembly to an ignition subassembly, and igniting the fuel or the accelerant with a resistance device disposed on the ignition subassembly to ignite the fuel or the accelerant. The method may further comprise removing the fuel igniter system from the underground energy source, adding fuel and/or accelerant to the fuel igniter system, inserting the fuel igniter system into the underground energy source, and re-igniting the fuel igniter system. The method may further comprise operating a downhole device with the information handling system, wherein the downhole device may be a paddle igniter system and the paddle igniter system may produce heat with an ignition sleeve. The method may further comprise releasing the ignition sleeve form the paddle igniter system, removing the paddle igniter system from the underground energy source, adding a second ignition sleeve to the paddle igniter system, inserting the paddle igniter system into the underground energy source, and re-igniting the paddle igniter system. The method may further comprise powering a laser source and transmitting light from the laser source through an optical fiber into the underground energy source. The method may further comprise operating a downhole device with an information handling system and the downhole device may be a chemical igniter system, mixing a first chemical and a second chemical in a chemical mix chamber, where a chemical reaction may produce heat.

The preceding description provides various embodiments of the systems and methods of use disclosed herein which may contain different method steps and alternative combinations of components. It should be understood that, although individual embodiments may be discussed herein, the present disclosure covers all combinations of the disclosed embodiments, including, without limitation, the different component combinations, method step combinations, and properties of the system.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

Therefore, the present embodiments are well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Although individual embodiments are discussed, the invention covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present invention.

What is claimed is:

1. An underground gasification system comprising:
a recovery system;
a supply line; and
a downhole ignition device operable to ignite an underground energy source, wherein the downhole ignition device is connected to the supply line and the supply line is connected to the recovery system, wherein the downhole ignition device comprises a piezoelectric igniter system, wherein the piezoelectric igniter system comprises a motor, a lance, a shaft, a cam, and a piezoelectric igniter, wherein the lance is a hollow tube, wherein the shaft is disposed within the lance.

2. The underground gasification system of claim 1, wherein an information handling system is operable to control the piezoelectric igniter system, wherein the information handling system operates the motor, and wherein the motor rotates the shaft which rotates the cam against the piezoelectric igniter.

3. The underground gasification system of claim 2, wherein the shaft connects the cam to the motor, wherein the piezoelectric igniter is deformable to create a voltage charge.

4. An underground gasification system comprising:
a recovery system;
a supply line; and
a downhole ignition device operable to ignite an underground energy source, wherein the downhole ignition device is connected to the supply line and the supply line is connected to the recovery system, wherein the downhole ignition device comprises a fuel igniter system, wherein the fuel igniter system comprises a connector, an electronic sensor subassembly, a fuel supply subassembly, and ignition subassembly, wherein the fuel supply subassembly comprises a first container and a second container.

5. The underground gasification system of claim 4, wherein an information handling system is operable to control the fuel igniter system, wherein an information handling system controls a flow of a fuel or an accelerant through the fuel supply subassembly to the ignition subassembly, and wherein the information handling system activates a resistance device disposed on the ignition subassembly to ignite the fuel or the accelerant.

6. The underground gasification system of claim 4, wherein the downhole ignition device is connected to the supply line through the connecter at a first end of the downhole ignition device, wherein a second end of the downhole device comprises a resistance device, a fuel nozzle, and a plurality of ports.

7. An underground gasification system comprising:
a recovery system;
a supply line; and
a downhole ignition device operable to ignite an underground energy source, wherein the downhole ignition device is connected to the supply line and the supply line is connected to the recovery system, wherein the downhole ignition device comprises a paddle igniter system, wherein the paddle igniter system comprises a motor, a lance, a shaft, a paddle, and an ignition sleeve that is ignitable, wherein the paddle is operable to frictionally engage the ignition sleeve.

8. The underground gasification system of claim 7, wherein an information handling system is operable to control the paddle igniter system, wherein the information handling system operates the motor, and wherein the motor rotates the shaft which rotates the paddle against the ignition sleeve.

9. The underground gasification system of claim 8, wherein as the paddle rotates against the ignition sleeve, the friction generated produces enough heat to ignite the ignition sleeve.

10. The underground gasification system of claim 7, wherein the ignition sleeve is consumable and burns away.

11. An underground gasification system comprising:
a recovery system;
a supply line; and
a downhole ignition device operable to ignite an underground energy source, wherein the downhole ignition device is connected to the supply line and the supply line is connected to the recovery system, wherein the downhole ignition device comprises a laser ignition system, wherein the laser ignition system comprises a laser source, a lance, an optical fiber, and a circulating valve.

12. The underground gasification system of claim 11, wherein an information handling system is operable to control the laser ignition system, wherein the information handling system turn the laser ignition system on or off.

13. The underground gasification system of claim 11, wherein the lance is a hollow tube, wherein the optical fiber is disposed within the lance and is operable to transmit a light from the laser source to a distance from the laser source.

14. A method for igniting an underground energy source comprising:
disposing a downhole ignition device into an injection well;
positioning the downhole ignition device within the underground energy source;
activating the downhole ignition device, wherein the downhole device is a chemical igniter system, wherein the chemical igniter system comprises a chemical mix chamber, a first chemical container, and a second chemical container;
mixing a first chemical and a second chemical in the chemical mix chamber to produce a combustion reaction;
igniting the underground energy source; and
recovering a gas from the underground energy source.

15. The method of claim 14, further comprising removing the downhole ignition device from the underground energy source, inserting oxygen, water, accelerant, or a combination thereof to control burning of the underground energy source, re-positioning the downhole ignition device within the underground energy source, and re-igniting the underground energy source with the downhole ignition device.

16. The method of claim 14, further comprising operating the downhole ignition device with an information handling system.

17. The method of claim 14, wherein the chemical igniter system further comprises a first valve and a second valve.

18. The method of claim 17, wherein the first chemical is disposed in the first chemical container and the second chemical is disposed in the second chemical container.

19. The method of claim 18, further comprising actuating the first valve to dispose the first chemical into the chemical mix chamber.

20. The method of claim 18, further comprising actuating the second valve to dispose the second chemical into the chemical mix chamber.

* * * * *